US006672439B2

(12) United States Patent
Platte, III

(10) Patent No.: US 6,672,439 B2
(45) Date of Patent: Jan. 6, 2004

(54) PAPER TOTE/ORGANIZER

(75) Inventor: Curtis Richard Platte, III, Simi Valley, CA (US)

(73) Assignee: Westrum, Inc., Van Nuys, CA (US)

( * ) Notice: Subject to any disclaimer, the term of this patent is extended or adjusted under 35 U.S.C. 154(b) by 0 days.

(21) Appl. No.: 10/167,371

(22) Filed: Jun. 10, 2002

(65) Prior Publication Data

US 2003/0226730 A1 Dec. 11, 2003

(51) Int. Cl.[7] ..... A45C 7/00
(52) U.S. Cl. ..... 190/103; 229/67.3; 206/425
(58) Field of Search ..... 190/103, 14, 100, 190/107, 108, 900, 902; 150/112, 113, 114, 111, 135, 138, 139, 148; 206/493, 425; 229/67.3, 67.4, 67.1

(56) References Cited

U.S. PATENT DOCUMENTS 554,574 A * 2/1896 Bennett ..... 206/425
3,312,384 A * 4/1967 Heynemann ..... 383/13
4,730,727 A * 3/1988 Petroff ..... 206/311
5,025,979 A * 6/1991 Dellacroce ..... 229/67.2
5,328,259 A * 7/1994 Meriaux ..... 312/184
5,630,509 A * 5/1997 Su ..... 206/425
5,788,032 A * 8/1998 Krulik ..... 190/108
5,857,778 A * 1/1999 Ells ..... 383/5
5,941,195 A * 8/1999 Martz ..... 119/497
5,947,279 A * 9/1999 Lee et al. ..... 206/232
5,954,170 A * 9/1999 Chisholm ..... 190/109
6,048,099 A * 4/2000 Muffett et al. ..... 383/20

FOREIGN PATENT DOCUMENTS

GB 2014955 A * 9/1979 ..... 206/425

* cited by examiner

*Primary Examiner*—Nathan J. Newhouse
*Assistant Examiner*—Lien Ngo
(74) *Attorney, Agent, or Firm*—Kelly Bauersfeld Lowry & Kelley, LLP

(57) ABSTRACT

A tote bag for paper and supplies includes a bottom wall extending between bottom edges of generally parallel front and back walls. Expandable side walls extend between parallel side walls of the front and back walls to form an expandable storage area. Dividers are disposed within the expandable storage area and either permanently attach to the side walls, or have apertures for removable attachment to cables within the storage area. A cover is movable between an open and closed position. The cover includes side flaps attachable to the side walls, or an inner surface of the cover. Handles extend from each of the front and back walls, and a strap formed on the back wall is configured to fit over an extendable handle of a roller tote.

23 Claims, 4 Drawing Sheets

PAPER TOTE/ORGANIZER

BACKGROUND OF THE INVENTION

The present invention generally relates to totes and organizing bags. More particularly, the present invention relates to a tote bag for storing and organizing paper and supplies, such as those used in photo albums or scrap books and the like.

It is, of course, generally known to provide a photo album for displaying pictures or other items that are generally flat in nature. Many photo albums and scrap books require mounts or special adhesives for attaching the photos or other items to the pages of the book. Other photo albums and books are known which have sheets that are removably attached to each of the pages. The pictures or items to be mounted on the page lay between the removable sheet and the page of the photo album.

More recently, activities such as scrap booking, art, assembling school reports, preparing formal presentations or business reports, collecting baseball cards, photography and other related pursuits have become increasingly popular. In particular, photo albums and scrap books have become more artistic and creative in nature including the use of colored pages. The pages are typically heavier weight construction-type paper often having ornate colors and designs imprinted thereon. Often, individuals secure their photos or other items and then place their own written notes or the like on those pages to create a storybook type album of personal photos and memorabilia.

Such elaborate scrap books often require the use of design-forming punches, various colored pens, scissors which cut a unique design to create esthetically pleasing pictures and cut-outs, etc. As these items can be quite expensive, scrap bookers often form groups and periodically meet with one another to share supplies and ideas. Aside from the economy of such groups, scrap bookers generally find pleasure in the social aspect of meeting with one another on a periodic basis.

However, such meetings require the transportation of the scrap book paper, photos, cut-outs and other supplies. For obvious reasons, a scrap booker wishes to protect the photos and relatively expensive construction-type paper.

Accordingly, there is a continuing need for a tote bag specifically designed to organize, store and transport paper, photographs, etc. The present invention fulfills this need and provides other related advantages.

SUMMARY OF THE INVENTION

The present invention resides in a tote bag for organizing, storing, and transporting paper and supplies, particularly those used in scrap booking and the like. Generally, the tote bag comprises a bag having expandable side walls and dividers to accommodate a varying amount of paper and supplies.

More particularly, the tote bag comprises substantially rigid front and back walls disposed generally parallel to one another. A substantially rigid bottom wall extends between bottom edges of the front and back walls. Expandable side walls comprised of a fabric material extend between respective parallel side walls of the front and back walls such that the front and back walls, bottom wall and side walls form an expandable storage area. This area is accessible through an opening defined by top edges of the front, back and side walls.

A pair of cables extend between flaps of the front and back walls within the storage area. Preferably, the cables are comprised of elastic material. Dividers of approximately the same dimension as the front and back walls, and generally the size of full sized sheets of paper, are disposed in the storage area and have apertures through which the cables pass through. In a particularly preferred embodiment, at least one of the dividers is permanently attached to the side walls. At least one of the dividers is removably attached to the cables. Preferably, at least one of the dividers has a pocket in an upper portion thereof for storage of paper or photographs which are less than full size.

A cover extends from the top edge of the back wall and is movable between an open position, and a closed position overlying the opening of the storage area. The cover has a flap securable to the front wall, such as by hook and loop tape fasteners. The cover includes side flaps extending from opposite ends thereof which are attachable to the side walls when the cover is in the closed position. The cover side flaps are also attachable to an inner surface of the cover, such as by hook and loop tape fasteners.

Handles extend from each of the front and back walls. A strap is attached at opposite ends thereof to the back wall, and forms a loop sized to fit over an extendable handle of a roller tote. The loop is detachably connected to the back wall with hook and loop tape fasteners. In this manner, the tote bag can be carried by hand, or inserted over the extendable handle and rolled, with other items, on a roller tote.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
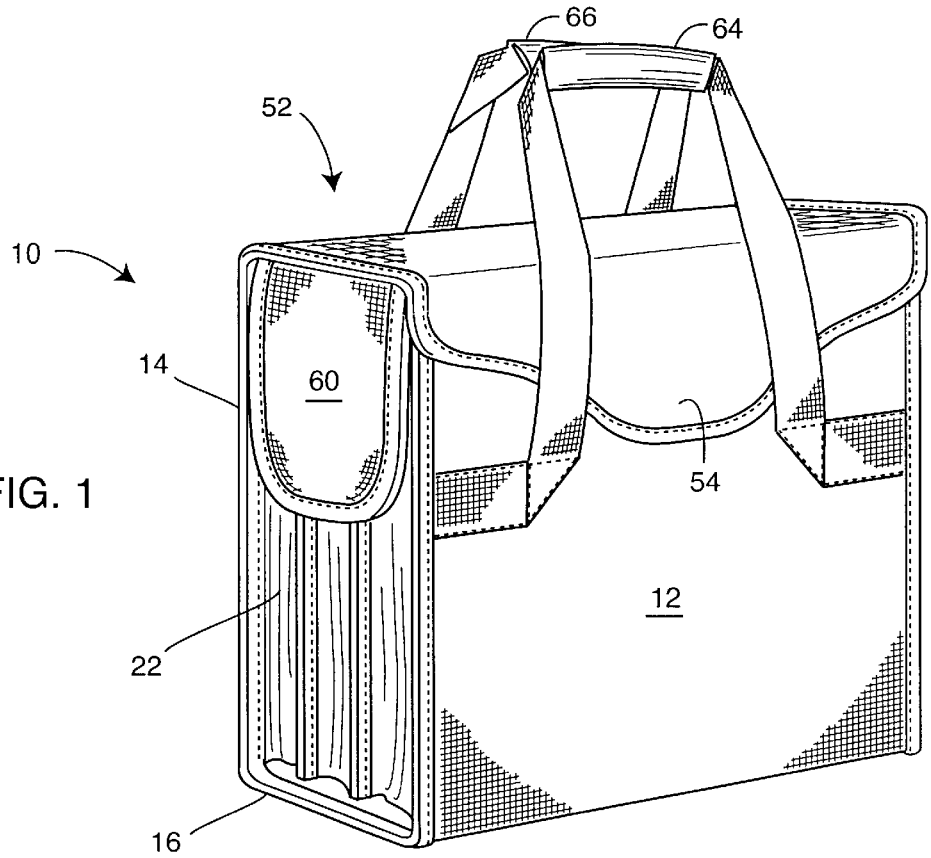
FIG. 1 is a perspective view of a tote bag embodying the present invention, in a closed position.

As shown in the drawings for purposes of illustration, the present invention resides in a tote bag, generally referred to by the reference number 10 in the various figures, that is designed and configured such so as to facilitate the organization, storage and transportation of supplies, and particularly paper and photographs for use in scrap booking and the like.

Figure 2:
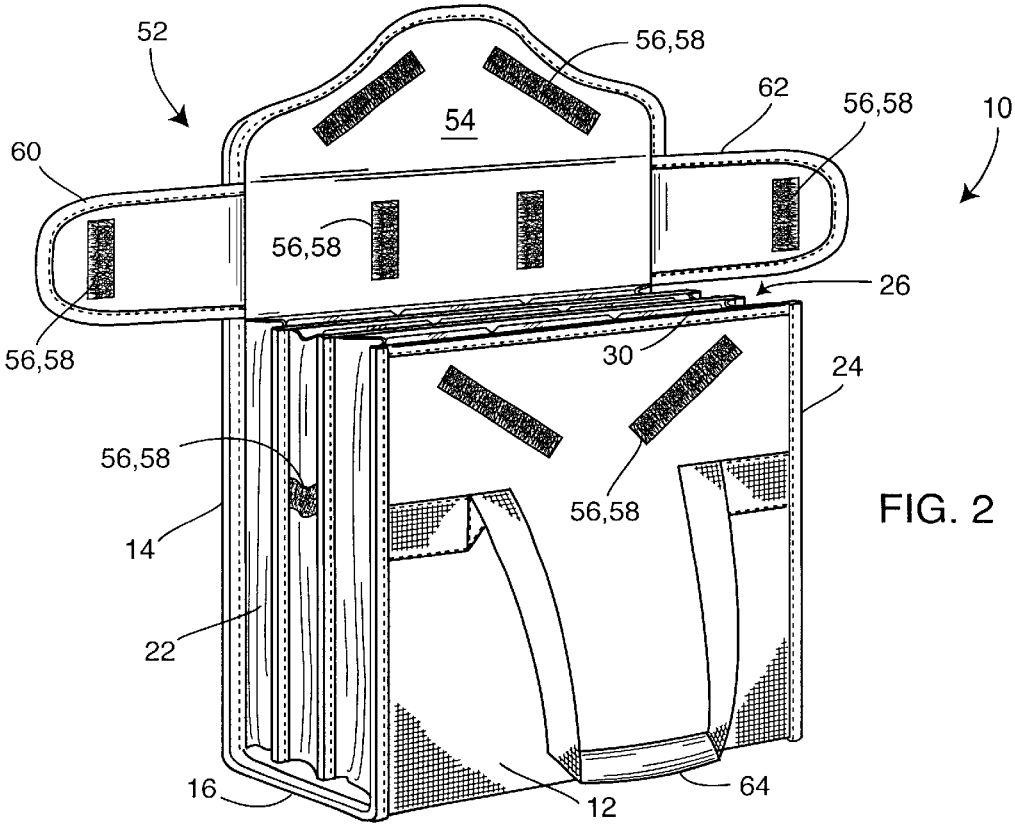
FIG. 2 is a perspective view of the tote bag of FIG. 1 in an open position.
Figure 3:
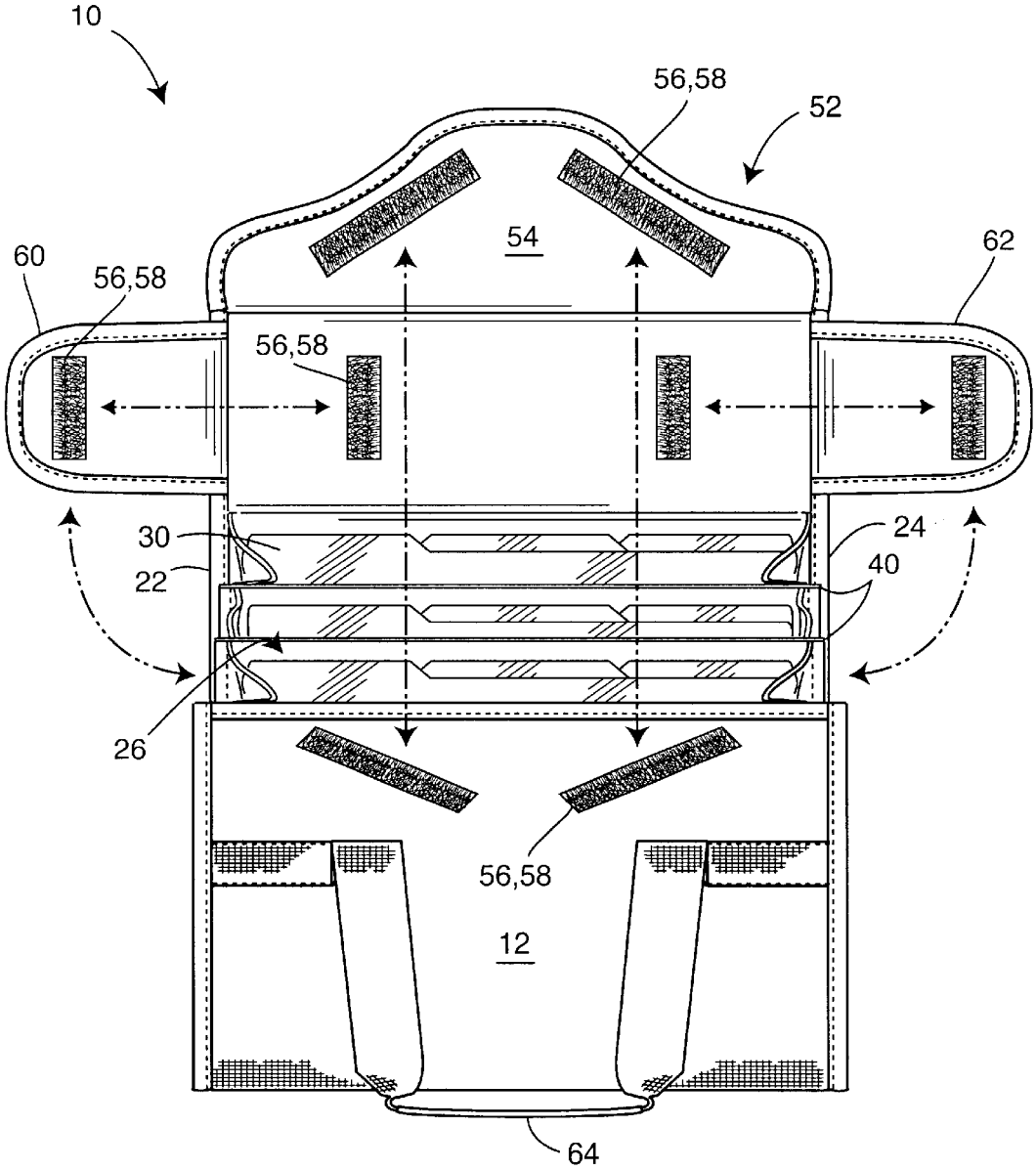
FIG. 3 is a front elevational view of the tote bag of FIG. 2, illustrating the various fastening points of a cover and side flaps of the tote bag.
Figure 4:
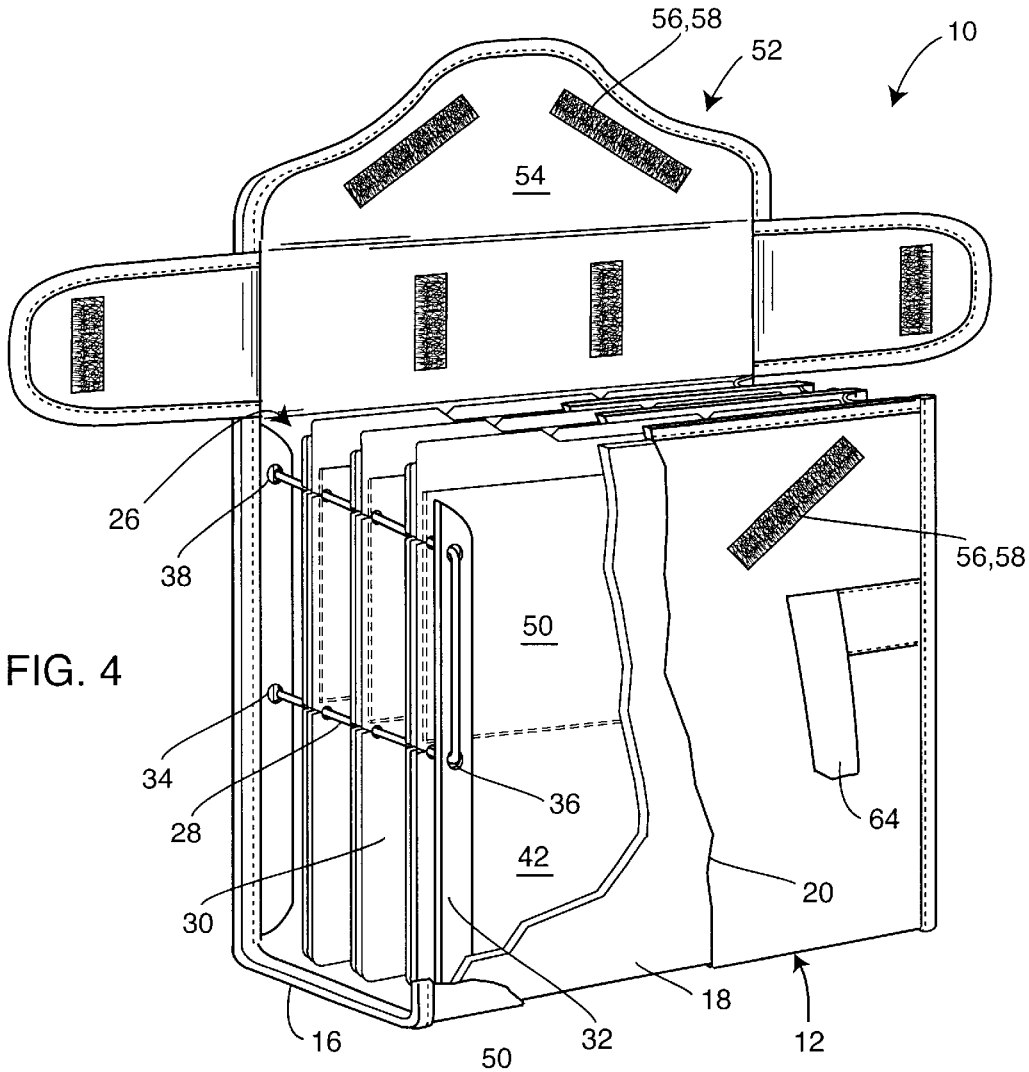
FIG. 4 is a partially fragmented perspective view of the tote bag, illustrating cables extending between flaps and supporting dividers within a storage area of the tote bag.

With reference now to FIGS. 1–4, the tote bag 10 is comprised of front and back walls 12 and 14 which are generally parallel to one another and slightly larger than the paper intended to be stored. Typically, the tote bag 10 is intended to store either 8.5×11" or 12"×12" sized paper. Bottom edges of the front and back wall 12 and 14 are interconnected with a bottom wall 16. It should be understood that in the process of manufacturing the tote bag 10 the front wall 12, back wall 14, and bottom wall 16 may be formed as a single piece, the front and back walls 12 and 14 being hinged at their bottom edges. In a particularly preferred embodiment, the front, back, and bottom walls 12–16 are fairly rigid so that the tote bag 10 can be placed on a surface, such as the ground or table and support itself in an upright position. As shown in FIG. 4, the front, back and bottom walls 12–16 include a rigid insert 18 comprised of plastic or cardboard or the like. These inserts 18 are encased within a fabric casing 20, such as a nylon fabric. Nylon fabric is preferred due to its water resistant characteristics, thus protecting the paper contents of the tote bag 10, although it should be understood that other fabric and materials could be implemented in the present invention.

Opposing side edges of the front and back walls 12 and 14 are interconnected with flexible accordion-type sidewalls 22 and 24. The side walls 22 and 24 are non-rigid in nature and typically comprised of a nylon fabric so that the tote bag 10 can be collapsed into a compact state when empty, and expanded as paper is added to the tote bag 10. The fabric of the side walls 22 and 24 is preferably of a nylon material or other water resistant material to protect the contents of the tote bag 10.

The front wall 12, back wall 14, bottom wall 16 and side walls 22 and 24 cooperatively form an expandable storage area 26 having an opening defined by the top edges of the front and back wall 12 and 14 and side walls 22 and 24. It will be appreciated by those skilled in the art that the storage area 26 is generally quadrilateral or cubical in nature so as to easily store the square or rectangular paper contents.

Figure 5:
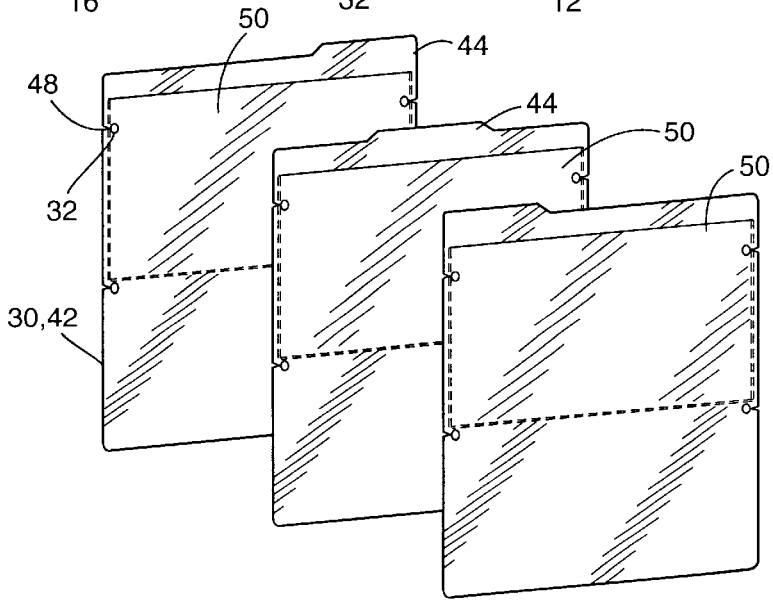
FIG. 5 depicts removable dividers having pockets formed in an upper portion thereof.

With particular reference now to FIGS. 4 and 5, a cable 28 extends between the side edges of the front and back walls 12 and 14 for support of dividers 30 therein. In a particularly preferred embodiment, relatively rigid flaps 32 and 34 have a longitudinal edge secured to the front and back wall 12 and 14, respectively. The flaps 32 and 34 include apertures 36 and 38 through which the cable 28 is threaded to form a generally U-shaped support, as shown in FIG. 4. Free ends of the cable 28 include knots or other members to prevent the cable 28 from exiting through the apertures 36 or 38. In a particularly preferred embodiment, the cable 38 comprises an elastic cable so as to be expandable and collapsible with the tote bag 10.

With reference to FIGS. 3–5, the tote bag 10 typically includes two permanent dividers 40 having their side edges fixed to the side walls 22 and 24, respectively. This creates three storage compartments within the tote bag 10. The elastic cable 28 extends through apertures of the permanent dividers 40. The present invention also incorporates the use of removable dividers 42 which are typically comprised of a sheet of plastic having tabs 44 offset from one another for labeling purposes, etc. The removable dividers 42 include apertures 46 having slits 48 extending to the outer edge thereof so that the elastic cable 28 can be snapped-fitted into the aperture 46 to support the removable dividers 42. In this fashion, a very large number of independent storage compartment areas can be created by the addition of the removable dividers 42.

Referring now to FIG. 5, the dividers 30, and more particularly the removable dividers 42 are configured to have a pocket 50 in an upper portion thereof. This is accomplished by attaching a smaller sheet of plastic, or the like, at its sides and bottom edges to the upper portion of the divider 40 to the top edge of the insert being unattached so as to form the pocket 50. This pocket 50 is particularly useful for scrap bookers and the like who can insert photographs or scraps of paper which are much smaller than the 8.5"×11" or 12"×12" size and which can become more difficult to find when it is commingled with the larger sized paper. As those skilled in the art will appreciate, it is not uncommon for scrap bookers to punch-out a section of the paper, or create a border or the like utilizing only a portion of a full-size piece of paper. The scrap booker may not wish to discard the remainder of the paper, opting instead to utilize the scrap at a later time for another punch-out, border, etc. The scrap booker can easily insert the scrap of paper, photo, etc. within the pocket 50 for its retrieval at a later time. As the tote bag 10 is designed and configured to organize paper by design, color, etc., the scrap of paper having the particular design or color can be inserted into the pocket 50 of the divider 42 associated with that design or color of paper, thus rendering easy retrieval due to the inherent organization of the tote bag 10.

Referring again to FIGS. 1–4, the tote bag 10 of the present invention includes a cover 52 which is movable between a closed position, as illustrated in FIG. 1, and an open position, as illustrated in FIGS. 2–4. The cover 52 may be formed unitarily with the casing 20 of the front, back, and bottom wall 16. Alternatively, the cover 52 may be sewn or otherwise attached to the top edge of the back wall 14. In either event, a hinged connection is formed between the top edge of the back wall 14 and the cover 52 to allow it to be moved between the open and closed positions.

The cover 52 includes a front flap 54 having fasteners which cooperate with fasteners on the outer surface of the front wall 12 to secure the cover 52 in a closed position. In a particularly preferred embodiment, the front flap 54 includes hook or loop tape attached to a inner surface thereof which affix to hook or loop tape 56 or 58 strategically positioned on the outer surface of the front wall 12 for removable connection therewith.

The cover 52 of the present invention also includes dog ears or side flaps 60 and 62 extending from opposite ends of the cover 52 and having hook or loop tape 56, 58 fastened thereto and removably attachable to a corresponding hook or loop tape fastener 56 or 58 attached to the side walls 22 and 24. Thus, as shown in FIG. 1, the cover 52 in its closed position entirely covers the opening 26 to the storage area on all sides, preventing moisture and the like from easily entering therein, even if the tote bag 10 is transported in wet conditions, such as a rain storm or the like. The side flaps 60 and 62 also prevent the accidental loss of any small scraps of papers and the like as the tote bag 10 is completely contained with the side flaps 60 and 62 secured to the side walls 22 and 24. As diagrammatically shown in FIG. 3, the side flaps 60 and 62 can also be attached to an inner surface of the cover by fastening the strips of hook or loop tape 56 or 58 to corresponding hook or loop tape fixed to an inner surface of the cover 52, so that the flaps 60 and 62 are not bothersome when the tote bag 10 is in the open position and being used, or the owner of the tote bag 10 opts not to utilize the side flaps 60 and 62.

As shown in FIGS. 1 and 2, the tote bag 10 includes handles 64 and 66 which are essentially comprised of strips of nylon attached to the front and back walls 12 and 14 respectively at ends thereof and having free intermediate section forming loops with attached grips or the like. This enables the tote bag 10 to be easily carried in the hand of the user.

Figure 6:
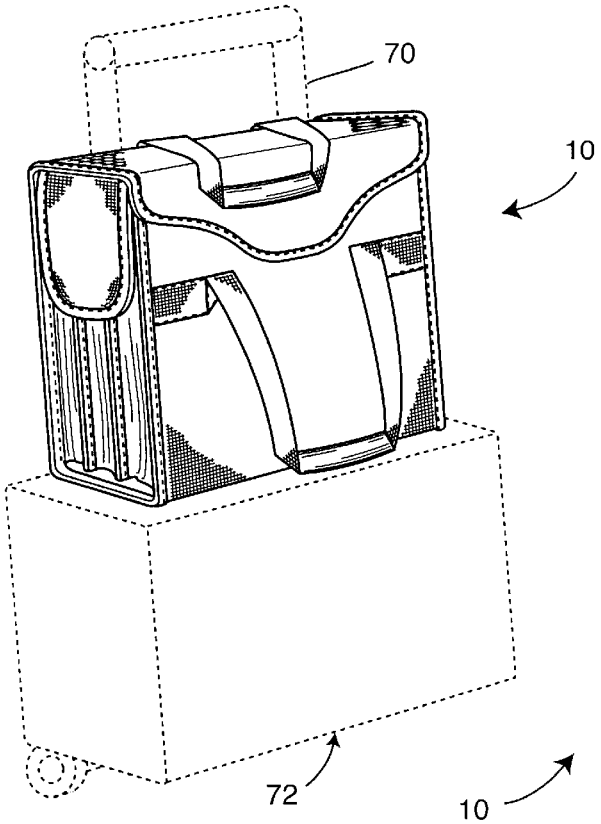
FIG. 6 is a perspective view of the tote bag attached to a roller tote, in phantom.
Figure 7:
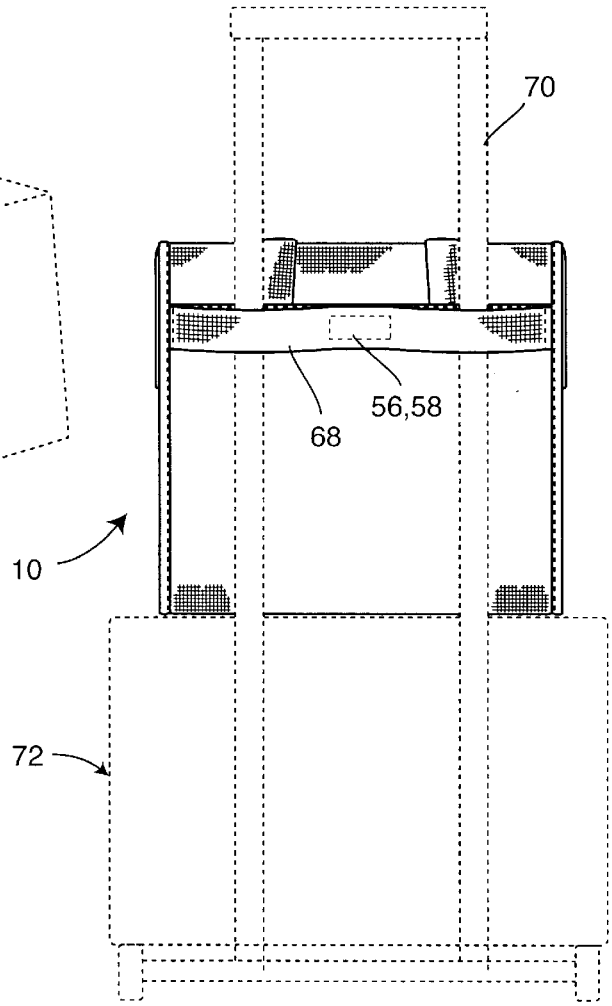
FIG. 7 is a rear perspective view of the tote bag, illustrating a loop thereof inserted over an extended handle of a roll tote for transportation.
Figure 8:
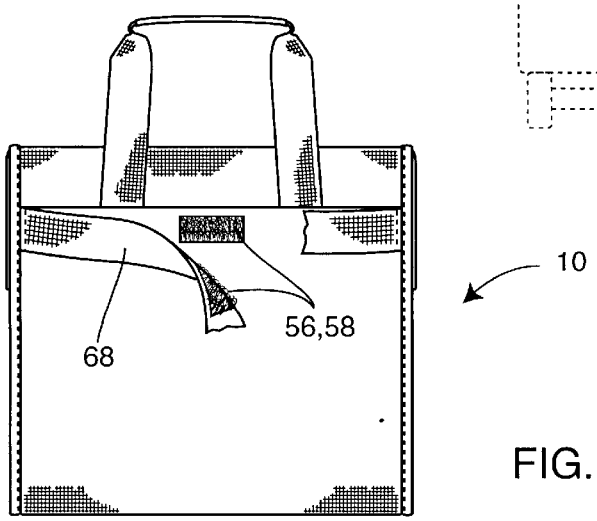
FIG. 8 is a rearview of the tote bag, illustrating hook and loop tape connection of the loop when not in use.

With reference now to FIG. 6, the tote bag 10 also includes a secondary loop 68 typically formed of nylon strips attached to the back wall 14 at opposite ends thereof and having a central area which can be placed over the handle 70 of a roller tote so that the tote bag 10 can be secured thereto and conveniently transported with the roller tote 72. Preferably, the loop section 68 includes a hook and loop tape fastener so as to be attached to the back wall 14 when not in use. Aside from providing esthetic appeal, this also prevents the accidental snagging, etc. of the otherwise free loop 68 by unintended objects.

Although several embodiments of the present invention have been described in detail for purposes of illustration, various modifications of each may be made without departing from the spirit and scope of the invention. Accordingly, the invention is not to be limited, except as by the appended claims.

What is claimed is:

1. A tote bag for paper and supplies, the tote bag comprising:

front and back walls disposed generally parallel to one another, a bottom wall extending between bottom edges of the front and back walls;

expandable side walls extending between respective parallel side walls of the front and back walls such that the front and back walls, bottom wall and sidewalls form an expandable storage area accessible through an opening defined by top edges of the front, back and side walls;

dividers of approximately the same dimension as the front and back walls disposed in the storage area;

a pair of cables extending between the front and back walls and through apertures of the dividers; and a cover extending from the top edge of the back wall and movable between a closed position overlying the opening and secured to the front wall, and an open position, wherein the cover includes side flaps extending from opposite ends thereof that are attachable to the side walls.

2. The tote bag of claim 1, wherein the cover side flaps are attachable to an inner surface of the cover.

3. The tote bag of claim 1, wherein the front, back and bottom walls are substantially rigid.

4. The tote bag of clam 1, wherein at least one of the dividers is permanently attached to the side walls, and wherein at least one of the dividers is removably attached to the cables.

5. The tote bag of claim 1, wherein the cables comprise elastic cables.

6. The tote bag of claim 1, wherein the cover includes a front flap that is removably attached to the front wall with hook and loop tape.

7. The tote bag of claim 1, including handles extending from each of the front and back walls.

8. The tote bag of claim 1, including a strap attached at opposite ends thereof to the back wall and forming a loop sized to fit over an extendible handle of a roller tote.

9. The tote bag of claim 8, wherein the loop is attachable to the back wall with hook and loop tape.

10. The tote bag of claim 1, including flaps extending from the side edges of the front and back wall to which ends of the cables are connected.

11. The tote bag of claim 1, wherein the side walls are comprised of a fabric material.

12. The tote bag of claim 1, wherein at least one of the dividers includes a pocket formed in an upper portion thereof.

13. A tote bag for paper and supplies, the tote bag comprising:

substantially rigid front and back walls disposed generally parallel to one another;

a substantially rigid bottom wall extending between bottom edges of the front and back walls;

expandable side walls extending between respective parallel side walls of the front and back walls such that the front and back walls, bottom wall and sidewalls form an expandable storage area accessible through an opening defined by top edges of the front, back and side walls;

dividers of approximately the same dimension as the front and back walls, disposed in the storage area, at least one of the dividers having a pocket in an upper portion thereof for storage for paper therein;

a pair of cables extending between the front and back walls and through apertures of the dividers;

a cover extending from the top edge of the back wall and movable between an open position and a closed position overlying the opening and having a flap securable to the front wall, the cover including side flaps extending from opposite ends thereof and attachable to the side walls in the closed position; and handles extending from each of the front and back walls.

14. The tote bag of claim 13, wherein the cover side flaps are attachable to an inner surface of the cover.

15. The tote bag of claim 13, wherein at least one of the dividers is permanently attached to the side walls, and wherein at least one of the dividers is removably attached to the cables.

16. The tote bag of claim 13, wherein the cables comprise elastic cables.

17. The tote bag of claim 13, including a strap attached at opposite ends thereof to the back wall and forming a loop sized to fit over an extendible handle of a roller tote, wherein the loop is attachable to the back wall with hook and loop tape.

18. The tote bag of claim 13, including flaps extending from the side edges of the front and back wall to which ends of the cables are connected.

19. The tote bag of claim 13, wherein the side walls are comprised of a fabric material.

20. A tote bag for paper and supplies, the tote bag comprising:

substantially rigid front and back walls disposed generally parallel to one another;

a substantially rigid bottom wall extending between bottom edges of the front and back walls;

expandable side walls comprised of a fabric material extending between respective parallel side walls of the front and back walls such that the front and back walls, bottom wall and sidewalls form an expandable storage area accessible through an opening defined by top edges of the front, back and side walls;

a pair of cables extending between flaps of the front and back walls;

dividers of approximately the same dimension as the front and back walls, disposed in the storage area and having apertures through which the cables pass through, wherein at least one of the dividers is permanently attached to the side walls, wherein at least one of the dividers is removably attached to the cables, and wherein at least one of the dividers has a pocket in an upper portion thereof for storage of paper therein;

a cover extending from the top edge of the back wall and movable between an open position and a closed position overlying the opening and having a flap securable to the front wall, the cover including side flaps extending from opposite ends thereof and attachable to the side walls in the closed position;

handles extending from each of the front and back walls; and a strap attached at opposite ends thereof to the ack wall and forming a loop sized to fit over an extendible handle of a roller tote, wherein the loop is attachable to the back wall with hook and loop tape.

21. The tote bag of claim 20, wherein the cover side flaps are attachable to an inner surface of the cover.

22. The tote bag of claim 20, wherein the cables comprise elastic cables.

23. The tote bag of claim 12, wherein an open upper edge of the pocket extends substantially the length of the divider.

* * * * *